US006257696B1

(12) United States Patent
Nakamura

(10) Patent No.: US 6,257,696 B1
(45) Date of Patent: Jul. 10, 2001

(54) INK JET RECORDER

(75) Inventor: Hirotake Nakamura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/053,756

(22) Filed: Apr. 2, 1998

(30) Foreign Application Priority Data

Apr. 3, 1997 (JP) ..... 9-085366

(51) Int. Cl.[7] ..... B41J 2/165; B41J 29/38
(52) U.S. Cl. ..... 347/30; 347/23; 347/5
(58) Field of Search ..... 347/5, 7, 20, 29, 347/30, 14, 35, 47, 84, 23, 9; 222/631, 255, 373; 399/253, 254, 257, 355

(56) References Cited

U.S. PATENT DOCUMENTS 5,726,692 * 3/1998 Yamaguchi et al. ..... 347/23

* cited by examiner

*Primary Examiner*—N. Le
*Assistant Examiner*—Shih-Wen Hsieh
(74) *Attorney, Agent, or Firm*—Oliff & Berridge, PLC

(57) ABSTRACT

An ink jet recorder includes a recording head having a plurality of ejection surfaces each containing a nozzle for ejecting a different ink, a purging device for purging the nozzle of one ejection surface at a time and a controller for the purging device. The controller controls the purging device such that a nozzle having an ink with higher dry resistance is purged before a nozzle having an ink with lower dry resistance. The ink jet recorder can prevent the nozzles from drying during the purging operation.

8 Claims, 8 Drawing Sheets

INK JET RECORDER

BACKGROUND OF THE INVENTION

1. Field of the Invention

The present invention relates to an ink jet recorder, such as an ink jet printer having a purging apparatus for sucking ink from a ink jet head and a purging method therefor.

2. Description of Related Art

Ink jet printers are known generally as ink jet recorders for recording on recording media, such as sheets of paper, by ejecting ink onto them. FIG. 9 of the accompanying drawings shows part of a conventional ink jet printer, which includes a recording head unit P3 having a recording head P2. The head P2 has four ejection nozzles P4, each of which has ejection holes (not shown) opening in its front surface P5. The ejection nozzles eject different colored inks including black, yellow, cyan and magenta, respectively. Four ink cartridges P1 containing the respective colored inks are mounted replaceably on the head unit P3, and each connected to the corresponding nozzle P4. After each cartridge P1 is replaced with a new one, ink is supplied from the new cartridge to the head P2, and can be ejected from the associated nozzle P4.

The printer is provided with a purging device having a cap P6 and a suction pump (not shown) in order to purge the nozzles P4. The purging may be started manually by the user operating a switch on the printer, or automatically if a predetermined condition is satisfied. The purging is performed to prevent the defective ejection of ink which may be caused if the ink in or on the recording head P2 dries, or if air bubbles are produced in the ink, or if droplets of ink stick to the nozzle surfaces P5. Specifically, the purging of each nozzle P4 involves covering its nozzle surface P5 with a suction cap P6, and then developing negative pressure in the cap P6 by means of a suction pump (not shown), in order to suck ink from the head P2 through the cap P6 and discharge the sucked ink outside.

Conventionally, when the purging operation is performed for all four ejection nozzles P4 successively, the nozzle for ejecting black ink is purged last. Namely, the purging operation has been done in order of lighter color inks. However, when the purging operation is performed in order of lighter color inks, there is a problem that some color inks tend to dry during the operation, because only one nozzle can be capped by the cap p6 at a time.

SUMMARY OF THE INVENTION

It is an object of the invention to provide an ink jet recorder which can prevent the ejection nozzles from drying during the purging operation.

According to a first aspect the invention, an ink jet recorder comprising:

a recording head having a plurality of ejection surfaces each containing a nozzle for ejecting a different ink;

a purging device for purging the nozzle of one ejection surface at a time within the plurality of ejection nozzles; and a controller for controlling the purging device in such a manner that a nozzle having an ink with higher dry resistance is purged before a nozzle having an ink with lower dry resistance is provided.

Inks used for the ink jet recorder are different from each other in a tendency of drying depending on component and composition of wetting agent, dye and like included therein. Accordingly, in the present invention, the purging operation for the plurality of ejection nozzles are performed in such manner that the nozzle for ejecting the ink with higher dry resistance is purged before the other nozzles ejecting the inks with lower dry resistance. Namely, as the ink has lower dry resistance, the corresponding nozzle to the ink is purged later. Therefore, each nozzle can be prevent from drying during the purging operation and an excellent recording can be maintained, especially in an initial recording stage subsequent to the purging operation.

In the recorder according to the invention, the purging device may comprise a suction cap to cover the one ejection surface at a time and a suction pump to suck the ink in the recording head though the nozzle and the suction cap, and the recorder may further comprise a moving device for moving the suction cap relative to the nozzle. The inks may be different each other in terms of color. As different inks in color have different dry resistance characteristics, a nozzle for ejecting a colored ink with higher dry resistant is purged first. The different inks may be magenta, cyan, yellow and black inks. In this case, it is preferable that the nozzle ejecting black ink is purged last because black ink generally tends to dry first among the colored inks. However, as described above, the dry resistance characteristic of ink can be determined by the components included therein and the composition thereof rather than the color.

The ink jet recorder according to the invention may further comprise a memory storing information on dry resistance characteristics of the different inks. In the ink jet recorder, the ejection surfaces may be arranged so as to be lined up from one end of the recording head according to the dry resistance characteristics of inks ejected from the ejection surfaces. Thereby, movement of the recording head relative to the purging device can be minimum and time for the purging operation can be shortened.

According to a second aspect of the invention, a purging method for an ink jet recorder comprising a recording head having a plurality nozzles for ejecting a plurality of colored inks and a purging device capable of purging one of nozzles at time, characterized in that a nozzle having an ink with higher dry resistance is purged before a nozzle having an ink with lower dry resistance is provided. Thereby, the nozzles of a recording head can be prevented from drying to ensure high recording quality.

BRIEF DESCRIPTION OF THE DRAWINGS

Preferred embodiments of the invention are shown in the accompanying drawings, in which.

DETAILED DESCRIPTION OF A PREFERRED EMBODIMENT

Figure 1:
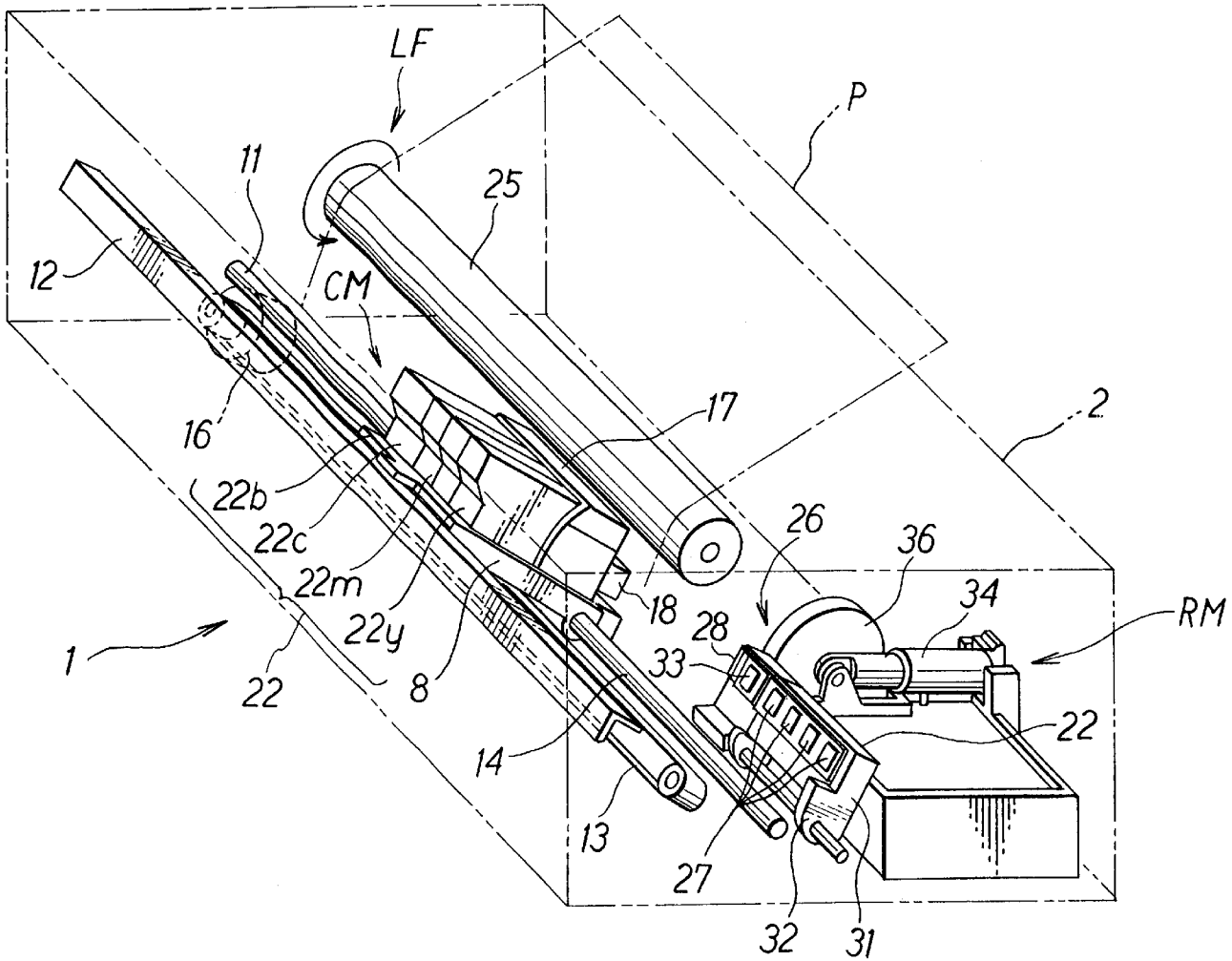
FIG. 1 is a perspective view of the internal structure of an ink jet printer according to the invention.

FIG. 1 shows the internal structure of an ink jet printer 1 according to an embodiment of the invention. The printer 1 includes a frame 2. A guide rod 11 and a guide member 12 extend horizontally in parallel, and are fixed to the frame 2. A carriage 8 is supported slidably on the rod 11 and member 12, and is fixed to a timing belt 13, which can be driven by a carriage drive motor (CR motor) 16 in order for the carriage 8 to reciprocate along the rod 11 and member 12. Mounted on the carriage 8 is an ink jet type recording head unit 17, which includes a recording head 18 for printing a recording sheet or medium P by ejecting droplets of ink of four colors (cyan C, magenta M, yellow Y and black B) onto the sheet.

Figure 2:
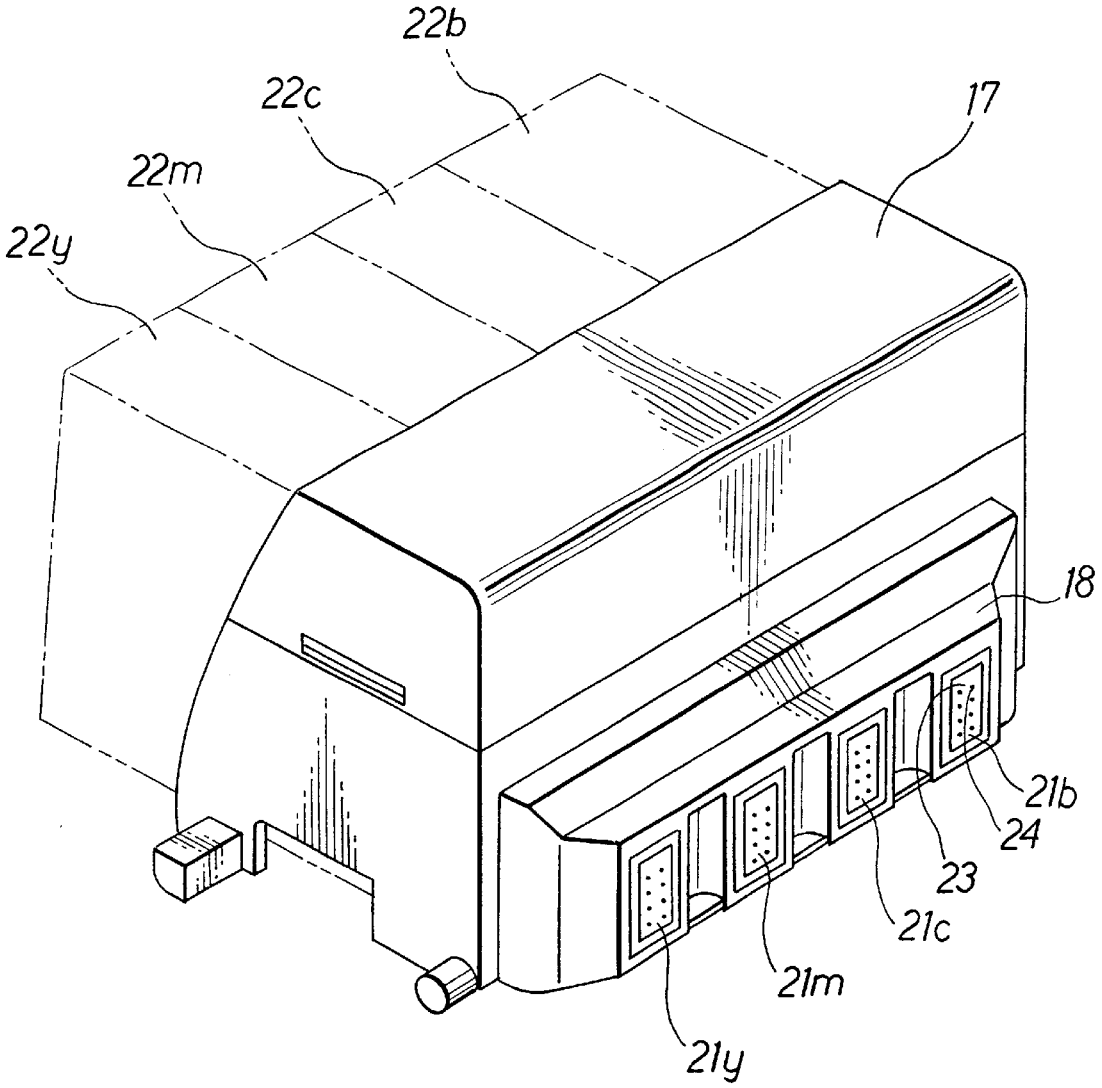
FIG. 2 is an enlarged perspective view of the recording head unit of the printer.

As shown in FIG. 2, the recording head 18 has injection nozzles 21 (21*y*, 21*m*, 21*c*, 21*b*). Mounted removably on the back side of the head unit 17 are ink cartridges 22 (22*y*, 22*m*, 22*c*, 22*b*) for supplying the nozzles 21*y*, 21*m*, 21*c* and 21*b*, respectively, with inks. Each nozzle 21 has a nozzle surface 23, where a number of ejection holes 24 open. The holes 24 may be 64 in number.

Back to FIG. 1, the recording head 18 faces a feed mechanism LF for feeding a recording sheet P. The mechanism LF includes a platen roller 25 extending in parallel to the guide rod 11 and member 12. The roller 25 is supported by the frame 2, and can be rotated by a feed motor (LF motor) 30 (FIG. 5) to feed a recording sheet P.

Positioned on one side of the feed mechanism LF is a maintenance/recovery mechanism RM for maintaining and recovering ejection of ink from the recording head 18. This mechanism RM includes a suction device 26 for eliminating defective ejection of ink, which may occur when the ink on or in the head 18 dries, when air bubbles are produced in the head, or when droplets of ink stick to the head nozzle surfaces 23. The mechanism RM also includes preservation caps 27 each for covering one of the nozzle surfaces (ejection surfaces) 23 to keep it wet while the printer 1 is not used. The mechanism RM further includes a wiper 28 for wiping the nozzle surfaces 23.

Figure 3:
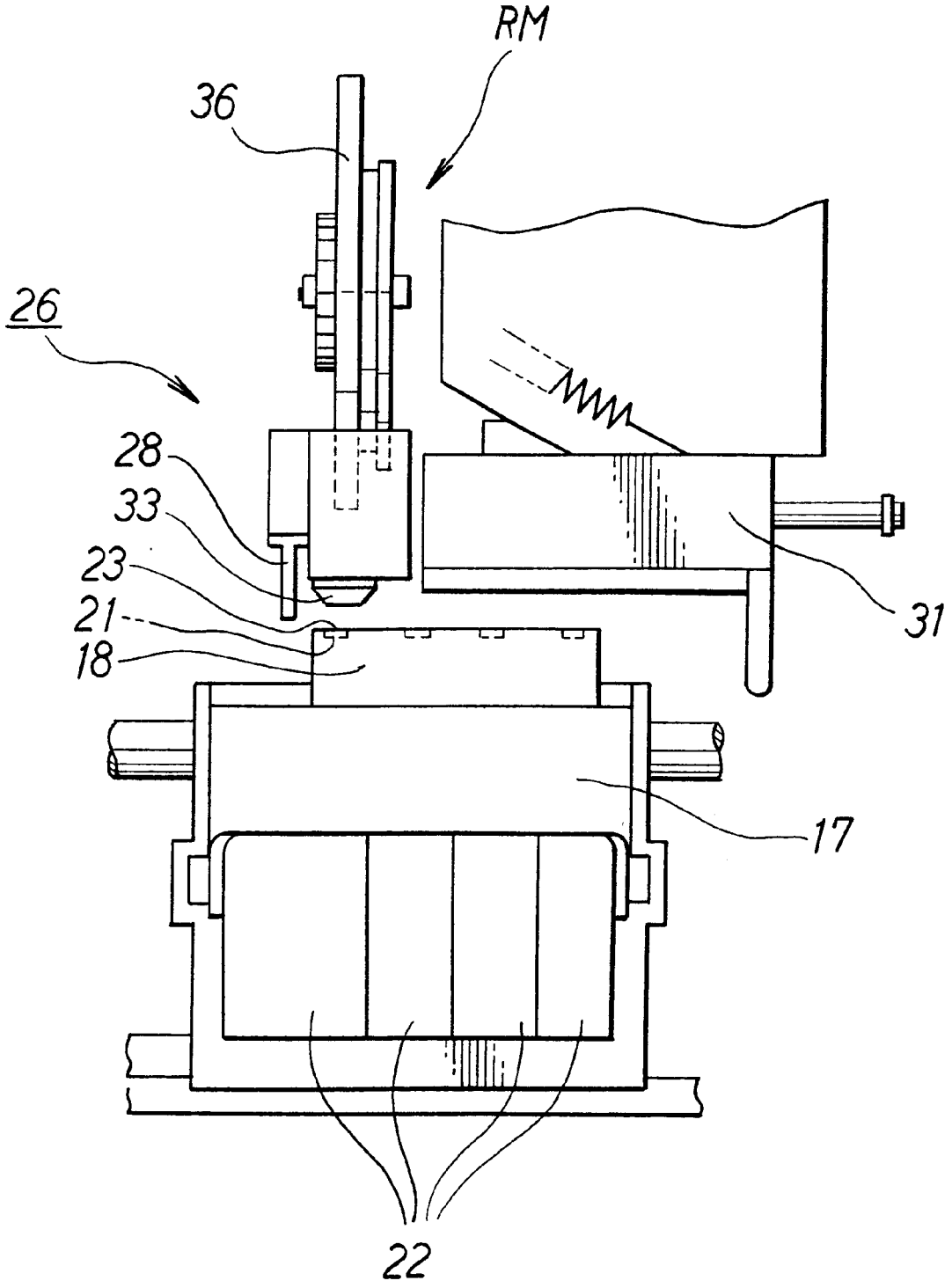
FIG. 3 is a perspective view showing structure of a maintenance/recovery mechanism of the printer shown in FIG. 1.
Figure 5:
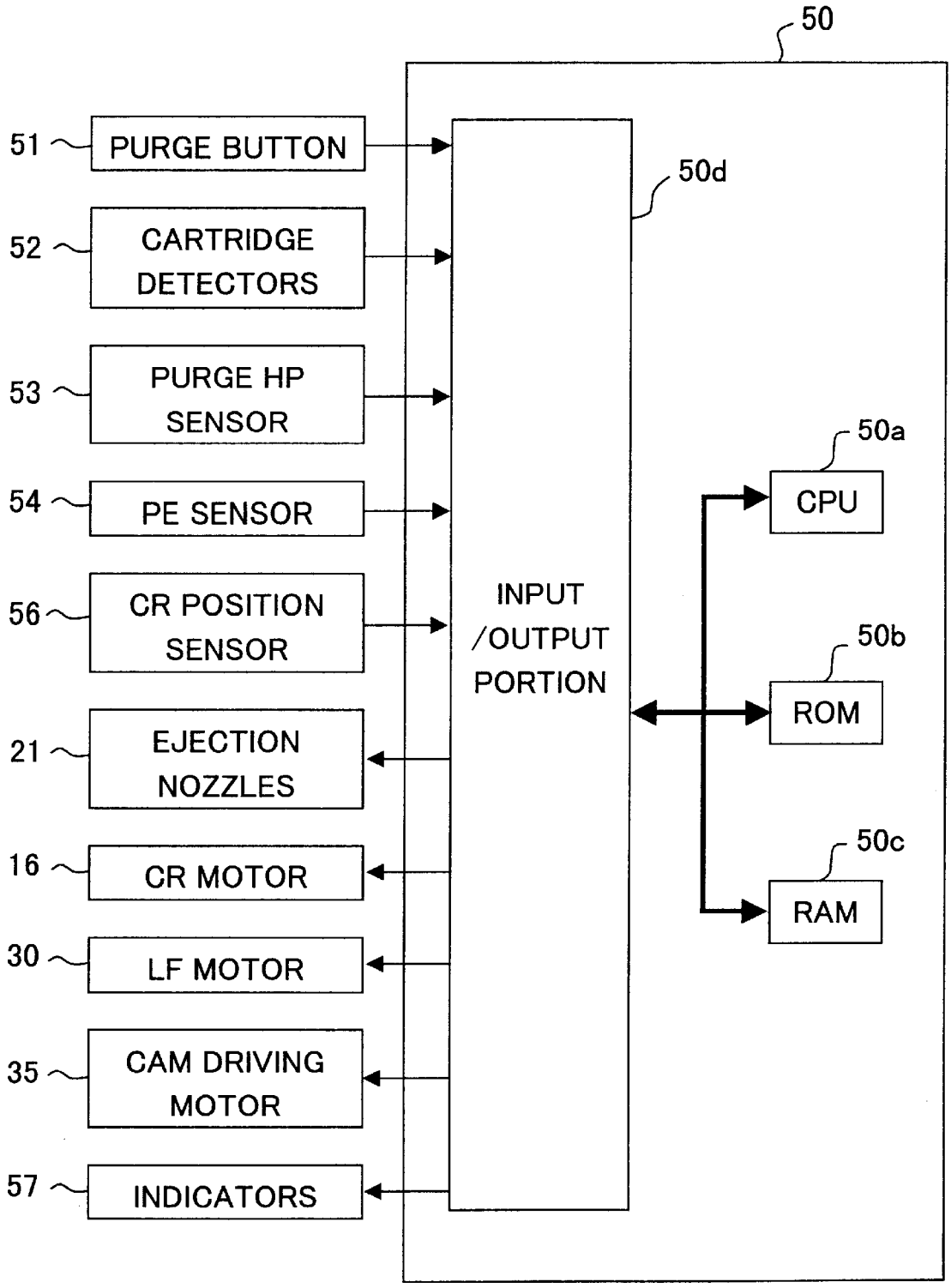
FIG. 5 is a block diagram of the electric structure or construction of the printer.

As shown in FIGS. 1 and 3, the suction device 26 includes a suction cap 33 which can move into and out of close contact with each nozzle surface 21 of the recording head 18. The suction device 26 also includes a suction pump 34 (FIG. 1) for sucking ink through the cap 33 from the head 18 while this cap is in close contact with the head. The maintenance/recovery mechanism RM also includes a cam 36 which can be driven by a cam drive motor 35 (FIG. 5). The cam 36 can move the suction cap 33 and the wiper 28 forward toward the recording head 18 and backward, and drive the pump 34 to purge the head through the suction cap.

Figure 4:
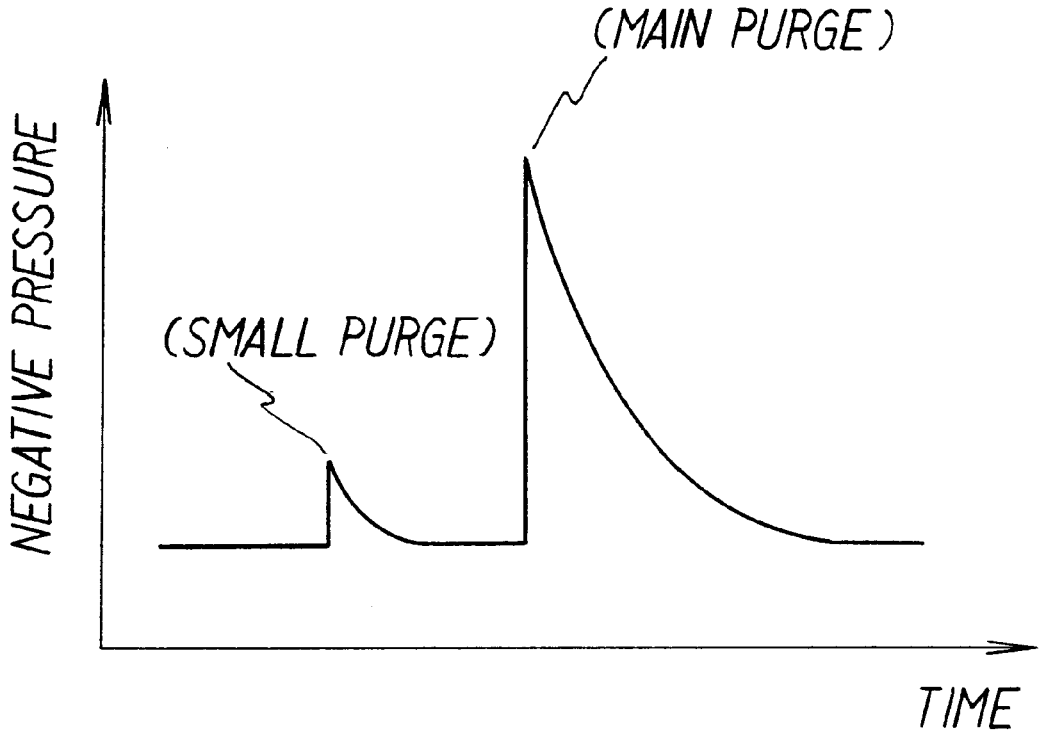
FIG. 4 is a graph showing the change in the negative pressure developed by the suction pump of the printer while the recording head of the printer is purged.

Specifically, while the pump 34 is reciprocating once, a cycle of suction is performed as shown in FIG. 4. The cycle includes a small purge with a low negative pressure and a main purge with a higher negative pressure. The small purge is followed by the main purge. Each ejection nozzle 21 may be purged normally by three cycles of the purges.

FIG. 5 shows the electric structure of the printer 1.

The printer 1 includes a control unit (ECU) 50, which is a well known microcomputer including a CPU 50*a*, a ROM 50*b*, a RAM 50*c* and an input/output port 50*d*. The control 50 controls the operation of the printer 1 in a manner for known printers.

The input/output port 50*d* is connected to a purge button 51 and other switches, cartridge detectors 52, a purge HP sensor 53, a PE sensor 54, a CR position sensor 56, etc. The purge button 51 can be pushed to instruct the control 50 to make the suction device 26 perform suction. Each cartridge detector 52 can detect an ink cartridge 22 being present on and absent from the head unit 17. The purge HP sensor 53 can sense the pump 34 being at its home position. The PE sensor 54 can sense the front end of a recording sheet P being fed. The CR position sensor 56 can sense the position of the carriage 8.

The input/output port 50*d* is also connected to the nozzles 21, which are actuators for ejecting ink, the CR motor 16, the LF motor 30, the cam drive motor 35 for driving the cam 36, which can drive the suction device 26, and indicators 57 for indicating the present operating conditions etc.

Figure 6:
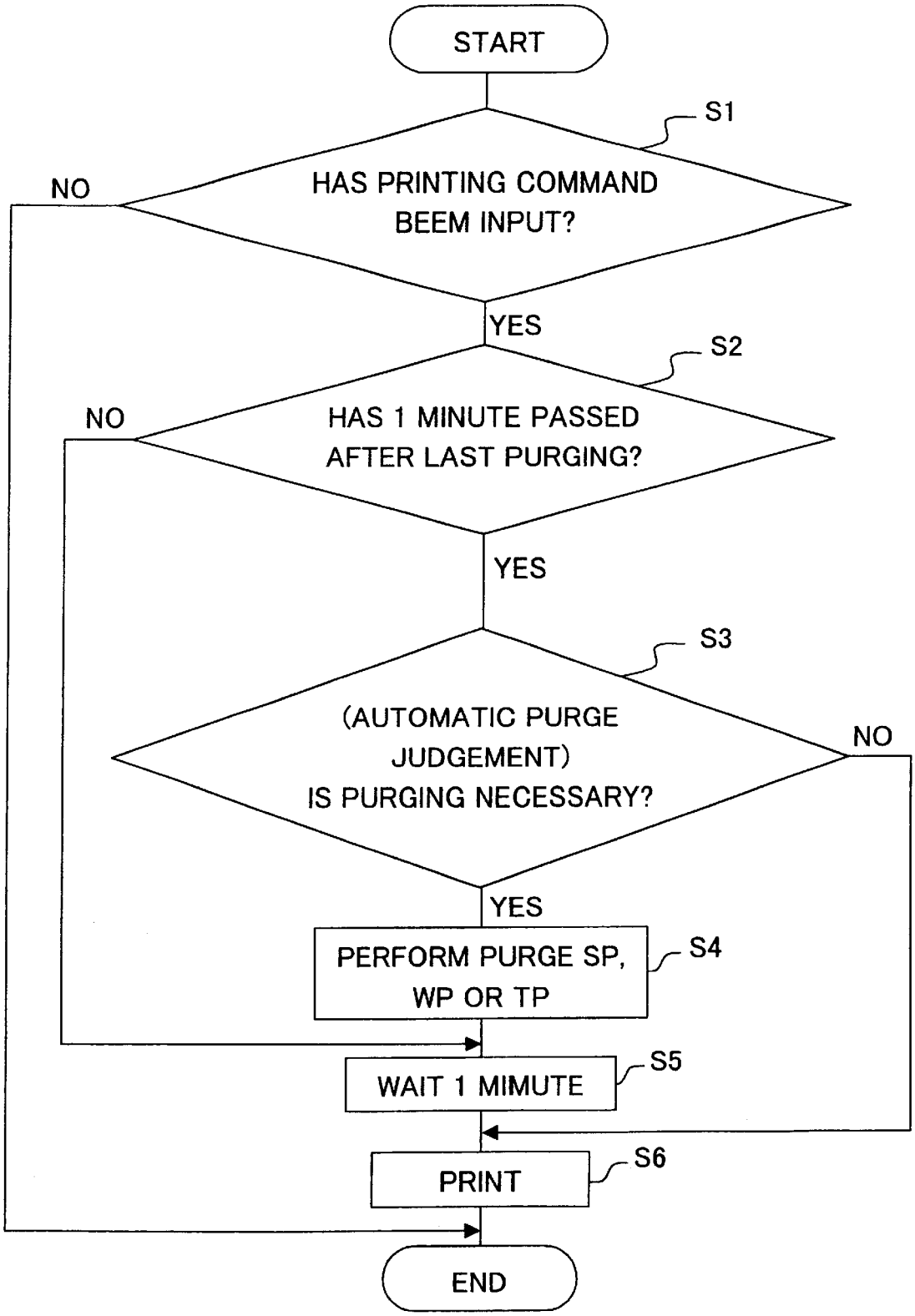
FIG. 6 is a flowchart of a control process for purging operation.
Figure 7:
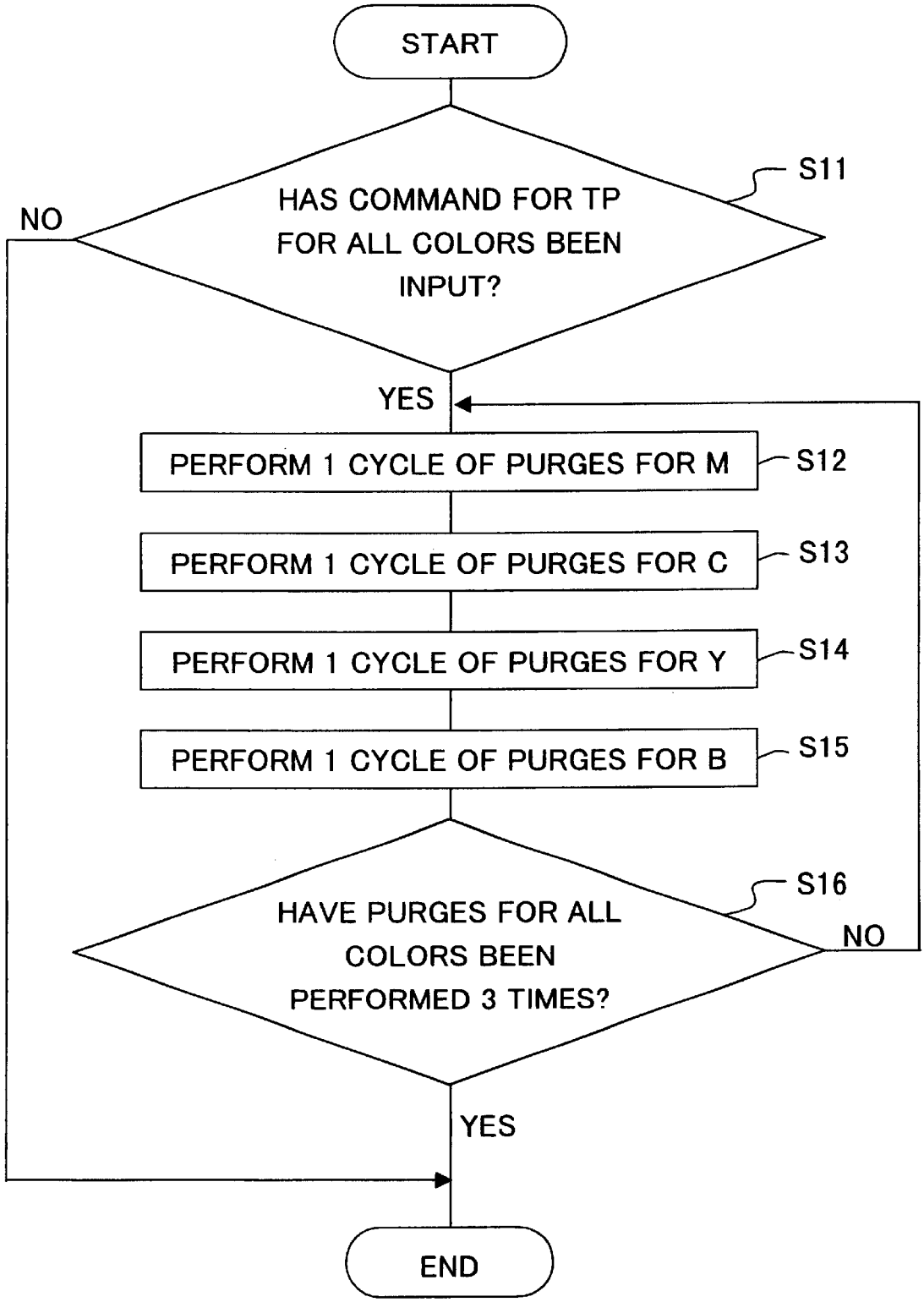
FIG. 7 is a flowchart of a control process of the order of purging operations.
Figure 8:
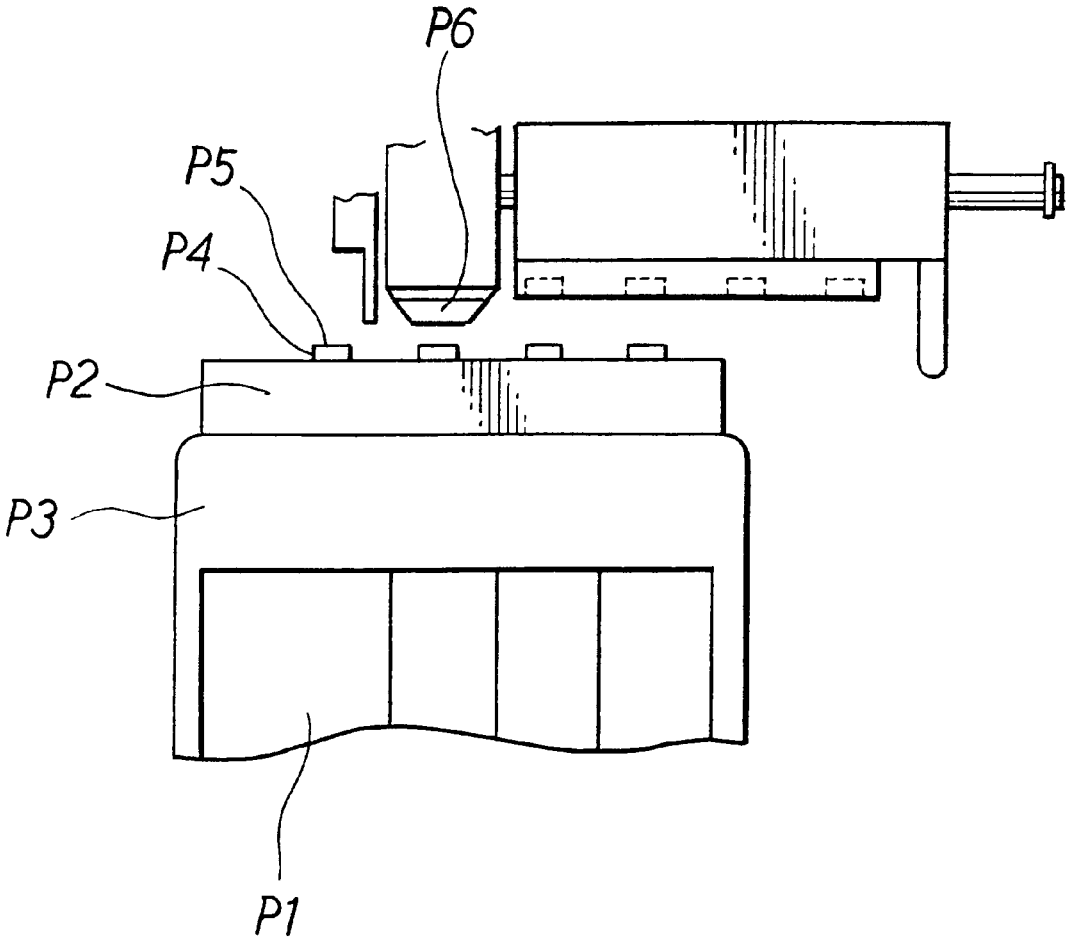
Fig. 8 PRIOR ART
FIG. 8 is a perspective view showing a conventional ink jet printer.

FIGS. 6 and 7 show a process of controlling the printer 1. In the following process, all four nozzles 21 are purged.

With reference to FIG. 6, it is judged whether a recording (printing) command has been input or not (S1). If it is judged that a recording command has been input (S1: yes), it is judged whether one minute has passed after the nozzle 21 was purged last (S2).

If it is judged that one minute has not passed after the last cycle of the purges (S2: no), the printer waits one minute for recording (S5). Thereafter, the nozzle 21 ejects ink for recording (S6), and then the process ends once. If it is judged that one minute has passed after the last cycle of the purges (S2: yes), an automatic purge judgment is made (S3).

The automatic purge judgment is to judge how many cycles of the purges to perform for the nozzle 21. The judgment may be based on the number of days or period after the nozzle 21 is purged last. If a very long period which is longer than one minute has not passed after the last cycle of the purges, the nozzle 21 may not be purged. If a short period more than one minute has passed after the last cycle of the purges, one cycle of the purges (single purge SP) is performed. If a longer period has passed, two cycles of the purges (double purge WP) are performed. If a still longer period has passed, three cycles of the purges (triple purge TP) are performed.

If the automatic purge judgment judges that a very long period has not passed after the nozzle 21 was purged last and it is therefore not necessary to purge the nozzle (S3: no), the recording is continued (S6). Then, the process ends once. If this judgment judges that a predetermined period has passed after the last purge and it is therefore necessary to purge the nozzle 21 (S3: yes), the nozzle 21 is moved to the purge position in front of the suction cap 33. Specifically, the nozzle 21 is moved properly to the purge position by the CR motor 16 being driven while the position of the carriage 8 is sensed by the CR position sensor 56. Then, one, two or three cycles of the purges are performed depending on the period after the last purge (S4). Thereafter, the printer 1 is forced to stand by for one minute (S5), and then recording is performed (S6). Then, the process ends once.

Now, the process of purging execution on step S4 will be described by using an example shown in the flowchart of FIG. 7 wherein three cycles of purging (TP) are performed for each color.

As shown in FIG. 7, it is judged by the automatic purging judgment whether the command for three cycles of purging (TP) has not been input or not (S11). If it is judged that the command for TP has not been input (S11: No), the process ends once and the other processes are performed. On the contrary, when the controller judges that the command for TP has been input (S11: Yes), one cycle purge for each ejection nozzle 21 corresponding to each color is performed in order of inks with higher dry resistance.

For example, one cycle of purging for the ejection nozzle 21*m* of magenta M color is performed first(S12), then one cycle of purging for the ejection nozzle 21*c* of cyan C color is performed (S13), then one cycle of purging for the ejected nozzle 21*y* of yellow Y color is performed, and finally one cycle of purging for the ejected nozzle 21*b* of black B color is performed.

With regard to the inks used in this embodiment, Cyan C is easier to dry than magenta M and yellow Y, however, there is no substantial difference in dry resistance among cyan C, magenta M and yellow Y compared with the difference between cyan C and black B. Therefore, the purging order may be changed among magenta M, yellow Y and cyan C. For example, the purging may be performed such that cyan C may be purged after the purging one of magenta M and yellow Y is completed.

Then, it is judged whether or not one cycle of purging for the ejection nozzles of all colors has been performed three times in total (S 16). When three times purges have not been performed (S16: No), similar purges are repeated (S12–S15). On the contrary, if the purges have been performed three times (S16: Yes), the process ends once and recording is performed at S6 in FIG. 6.

Thus, in the embodiment, when purges are performed for ejection nozzles 21 for all colors, the ejection nozzles corresponding to the respective colors are purged in order of colored ink with higher dry resistance. Therefore, when the recording is performed in practice, all colored inks are prevented from drying. As a result, the defective recording in recording subsequent to the purging operation can be reduced.

The invention is not limited to embodiments described above and may be performed in various specific forms without departing from the sprit of the invention. For example, the ink jet recorder may be provided with a memory like ROM in which an order of dry resistance of colored inks has been stored. In this case, when a user designates two or more nozzles for purging by means of switching operation for the purpose of overcoming dot lack or introducing a new ink into the recording head after an exchange of the ink cartridge, the purging operation may be performed for the two or more nozzles according to the order of dry resistance of colored inks stored in ROM. The embodiment has been explained for the ink jet printer, but the invention may be applied to any types of recorders such as a facsimile machine.

What is claimed is:

1. An ink jet recorder, comprising:

a recording head having a plurality of ejection surfaces each containing a nozzle for ejecting a different ink;

a purging device for purging the nozzle of one ejection surface at a time within the plurality of ejection nozzles; and a controller for controlling the purging device in such a manner that a nozzle having an ink with higher dry resistance is purged before a nozzle having an ink with lower dry resistance.

2. The ink jet recorder according to claim 1, wherein the purging device comprises a suction cap to cover the one ejection surface and a suction pump to suck an ink in the recording head through the suction cap and the nozzle, and the recorder further comprises a moving device for moving the suction cap relative to the nozzle.

3. The ink jet recorder according to claim 1, wherein each nozzle ejects a different colored ink.

4. The ink jet recorder according to claim 3, wherein the plurality of ejection surfaces are for ejecting magenta, cyan, yellow and black inks, respectively.

5. The ink jet recorder according to claim 4, wherein black ink is purged last.

6. The ink jet recorder according to claim 1, further comprising a memory storing information on an order of dry resistance characteristics of inks ejected from the ejection surfaces.

7. The ink jet recorder according to claim 1, wherein the surfaces are arranged so as to be lined up from one end of the recording head according to the dry resistance characteristics of inks ejected from the ejection surfaces.

8. A method for purging an ink jet recorder, comprising the steps of:

ejecting a plurality of colored inks from a recording head having a plurality of nozzles; and purging the plurality of nozzles, wherein a nozzle having an ink with a higher dry resistance is purged before a nozzle having an ink with a lower dry resistance.

* * * * *